US006340341B1

(12) United States Patent
Purcell

(10) Patent No.: US 6,340,341 B1
(45) Date of Patent: Jan. 22, 2002

(54) WEIGHTED DEVICE FOR MAINTAINING THE ARM IN A PROPER POSITION FOR MAXIMIZING PECTORAL MUSCLE EXERCISING

(76) Inventor: Farrell W. Purcell, 1952 Everding St., Eureka, CA (US) 95503

( * ) Notice: Subject to any disclaimer, the term of this patent is extended or adjusted under 35 U.S.C. 154(b) by 0 days.

(21) Appl. No.: 09/498,972

(22) Filed: Feb. 7, 2000

(51) Int. Cl.[7] ..... A63B 21/00; A63B 21/06
(52) U.S. Cl. ..... 482/108; 482/106; 482/139
(58) Field of Search ..... 482/93, 105–109, 482/137, 138, 139, 905

(56) References Cited

U.S. PATENT DOCUMENTS

| | | | | | |
|---|---|---|---|---|---|
| 2,617,650 | A | | 11/1952 | Landis | 272/84 |
| 2,819,081 | A | | 1/1958 | Touraine | 272/67 |
| 4,039,183 | A | | 8/1977 | Sakurada | 272/67 |
| 4,109,908 | A | | 8/1978 | Pugh et al. | 272/119 |
| 4,345,756 | A | | 8/1982 | Hoagland | 272/117 |
| 4,484,740 | A | | 11/1984 | Green | 272/119 |
| 4,607,840 | A | * | 8/1986 | Harper | 482/109 |
| 4,943,052 | A | * | 7/1990 | Powers | 482/108 |
| 5,096,190 | A | | 3/1992 | Montgomery | 272/117 |
| 5,110,119 | A | * | 5/1992 | Arnold | 482/93 |
| 5,350,345 | A | | 9/1994 | Frey | 482/105 |
| 5,540,640 | A | * | 7/1996 | Povilaitis | 482/108 |
| 5,573,484 | A | | 11/1996 | Carpenter | 482/108 |
| 5,741,206 | A | * | 4/1998 | Anatasi | 482/105 |

* cited by examiner

*Primary Examiner*—Stephen R. Crow
(74) *Attorney, Agent, or Firm*—Richard L. Miller

(57) ABSTRACT

A weight device for maintaining the arm in a proper position for maximizing pectoral muscle exercising. The device includes an arm-capturing bracket, a hand-engaging handle, and a weight-engaging shaft. The arm-capturing bracket includes an upper arm-capturing bracket, and a lower arm-capturing bracket that extends perpendicularly from the upper arm-capturing bracket. The upper and lower arm-capturing brackets are U-shaped plates and meet each other at an elbow-engaging sleeve. The hand-engaging handle includes an arm that extends vertically upwardly from the lower arm-engaging bracket. The weight-engaging shaft extends through and past the elbow-engaging sleeve and receives a weight. In an alternate embodiment, the arm-capturing bracket is adjustable for different sized arms.

16 Claims, 1 Drawing Sheet

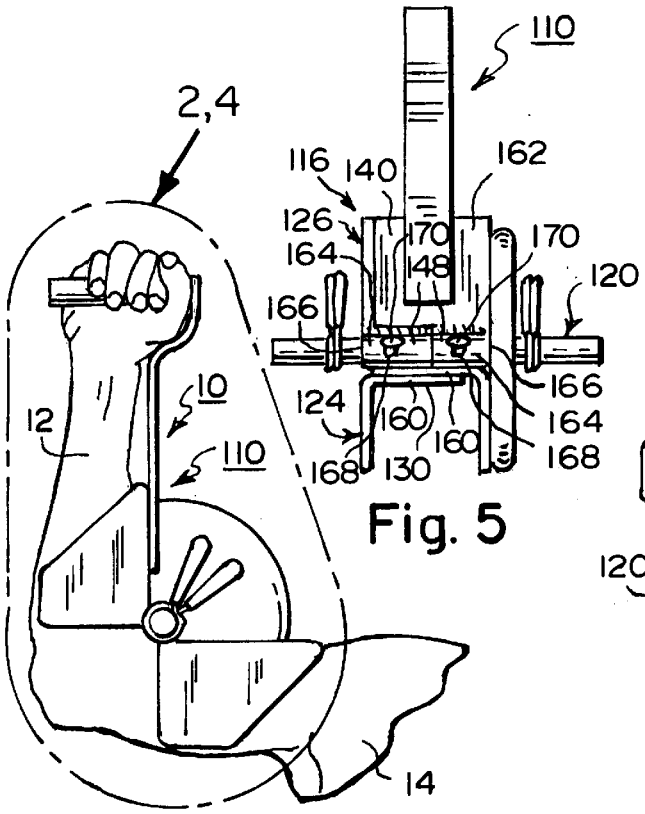
Fig. 1
Fig. 5
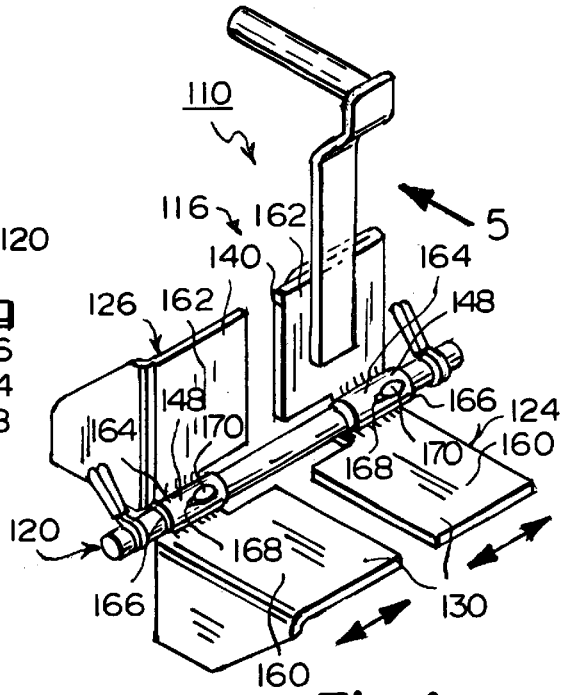
Fig.4
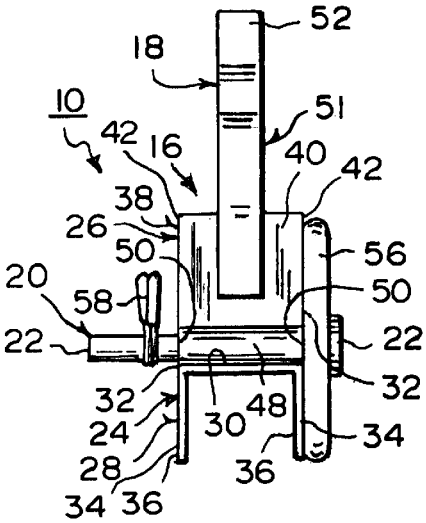
Fig. 3
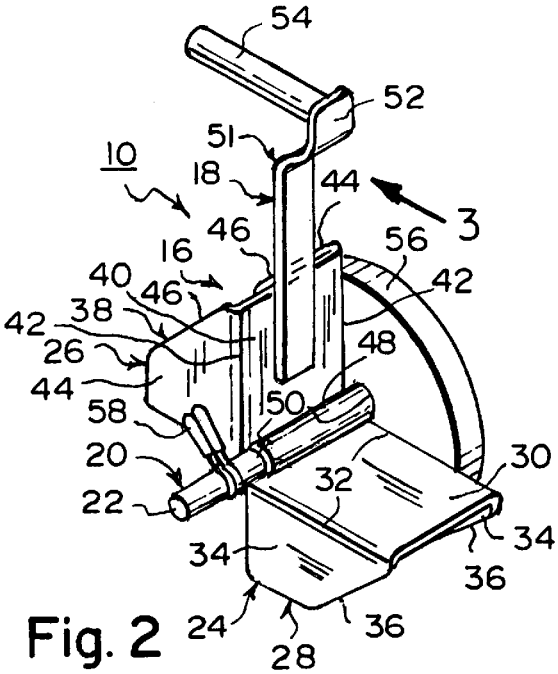
Fig. 2

WEIGHTED DEVICE FOR MAINTAINING THE ARM IN A PROPER POSITION FOR MAXIMIZING PECTORAL MUSCLE EXERCISING

BACKGROUND OF THE INVENTION

1. Field of the Invention

The present invention relates to a weight device. More particularly, the present invention relates to a weight device for maintaining the arm in a proper position for maximizing pectoral muscle exercising.

2. Description of the Prior Art

Numerous innovations for weight exercising devices have been provided in the prior art that will be described. Even though these innovations may be suitable for the specific individual purposes to which they address, however, they differ from the present invention.

A FIRST EXAMPLE, U.S. Pat. No. 2,617,650 to Landis teaches an exercising device comprising a free unitary structure and including an arm receiving ring, a handle spaced from said ring and disposed substantially parallel to a diameter thereof, side bars extending in spaced apart and substantially parallel relationship between said ring and said handle and each secured at one end to said ring and at its other end to said handle, pins connected one to each side bar for movements of adjustment longitudinally of the side bars, and projecting outwardly from the corresponding side bars, and weights mounted on said pins.

A SECOND EXAMPLE, U.S. Pat. No. 2,819,081 to Touraine teaches an exerciser comprising a platform, an upwardly directed outer ring secured to said platform, an inner ring having an annular groove extending about its outer circumference and having a diametrical hand-grip secured thereto, and single means for retaining said inner ring concentric with and rotatable within said outer ring and for permitting at will variation of the forces required to rotate said inner ring with respect to said outer ring, said single means comprising a plurality of set screws disposed about the circumference of said outer ring and extending therethrough into the annular groove in said inner ring and into at will variable frictional engagement with the bottom wall of said groove.

A THIRD EXAMPLE, U.S. Pat. No. 4,039,183 to Sakuradia teaches a device for exercising and strengthening the human wrist, which comprises a concave trough with two parallel spaced members projecting from one end thereof and a grip rotatably mounted on the elongated member. Springs provide a force which rotates the grip away from the longitudinal axis of the concave trough. The device fits on the human forearm directly above the wrist and provides wrist strengthening exercises for the user by means of the grip being biased by the force of the springs against the flexing of the wrist.

A FOURTH EXAMPLE, U.S. Pat. No. 4,109,908 to Pugh et al. teaches an elongated body including first and second opposite sides. A shank-type handgrip projects endwise outwardly from one side of the body at one end thereof and a forearm encircling open frame projects outwardly of the same side of the body at the other end thereof. An elongated shank-type weight support structure projects endwise outwardly of the other side of the body centrally intermediate the opposite ends thereof and is adapted to have conventional apertured disc-type weights mounted thereon. The apparatus comprising the body, the handgrip, the frame and the shank-type weight supporting structure is adapted to be used by a person wishing to exercise his upper arm and shoulders and to develop the "forearm blow" utilized in high school, college and professional football blocking.

A FIFTH EXAMPLE, U.S. Pat. No. 4,345,756 to Hoagland teaches an adjustable dumbbell apparatus which is particularly adapted to maintain the arms of the exerciser in a straight orientation when used with weighted members which includes a circumferential member defining a hole therethrough through which the arm of the exerciser is adapted to extend. A first and second strut are fixedly secured to the circumferential member to be parallel with respect to the hole therein and extend upwardly therefrom. A grip extends between the upper ends of the struts such that the user can grasp this grip when his arm is extending through the hole in the circumferential member. A weighted support bar is adapted to extend outwardly from the circumferential member and is fixedly secured thereto. The weighted support member extends outwardly perpendicular approximately with respect to the axis of the hole in such a fashion as to use the weights when placed on the weight support member to urge the arm of the exerciser into the straight orientation. Alternatively, a collar may be threadably securable to the externally threaded bar of the weight support member to facilitate securement of weighted members thereto. Also alternatively, the individual struts may be formed of an outer tubular member and an inner member which telescopically moves with respect to one another to adjust the distance between the circumferential member and the grip.

A SIXTH EXAMPLE, U.S. Pat. No. 4,484,740 to Green teaches a weight training device that includes a splint-like member adapted to be attached to the underside of the forearm of a person engaged in exercising with training weights. The splint-like member extends from a point sufficiently below the elbow to permit flexing of the arm to a point in the palm of the hand. Structures are provided for attaching the splint-like member to the forearm and for attaching a training weight, such as a dumbbell or barbell, at the wrist section of the splint-like member. The splint-like member is curved upwardly at the palm end so as to provide a grip for the fingers.

A SEVENTH EXAMPLE, U.S. Pat. No. 5,096,190 to Montgomery teaches a method together with an apparatus for exercising shoulder muscles wherein a weight is utilized by hanging over the upper arm and the hand of the same arm controls and manipulates the weight and the shoulder muscle system by movement of the hand and arm cooperatively with the weight.

A EIGHTH EXAMPLE, U.S. Pat. No. 5,350,345 to Frey teaches an exercise apparatus for an arm of a user which includes a support having a first part for supporting and extending along a portion of the user and a second part having an outwardly curved portion for supporting the wrist of the user in an extended position to increase the work load on the upper arm or biceps during exercise.

A NINTH EXAMPLE, U.S. Pat. No. 5,573,484 to Carpenter teaches an auxiliary handle for a dumbbell that includes a pair of weighted hook members each joined to a handle by a threaded stud. The hook members are adapted to engage the handle of a dumbbell. The studs are oppositely threaded so that rotation of the handle in one direction moves the hook members away from each other and into engagement with the dumbbell weights, thus securing the auxiliary handle to the dumbbell. The auxiliary handle may be used by a spotter to assist in handling the dumbbell.

It is apparent that numerous innovations for weight exercising devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a weight device for maintaining the arm in a proper position for maximizing pectoral muscle exercising that avoids the disadvantages of the prior art.

ANOTHER OBJECT of the present invention is to provide a weight device for maintaining the arm in a proper position for maximizing pectoral muscle exercising that is simple and inexpensive to manufacture.

STILL ANOTHER OBJECT of the present invention is to provide a weight device for maintaining the arm in a proper position for maximizing pectoral muscle exercising that is simple to use.

BRIEFLY STATED, YET ANOTHER OBJECT of the present invention is to provide a weight device for maintaining the arm in a proper position for maximizing pectoral muscle exercising. The device includes an arm-capturing bracket, a hand-engaging handle, and a weight-engaging shaft. The arm-capturing bracket includes an upper arm-capturing bracket, and a lower arm-capturing bracket that extends perpendicularly from the upper arm-capturing bracket. The upper and lower arm-capturing brackets are U-shaped plates and meet each other at an elbow-engaging sleeve. The hand-engaging handle includes an arm that extends vertically upwardly from the lower arm-engaging bracket. The weight-engaging shaft extends through and past the elbow-engaging sleeve and receives a weight. In an alternate embodiment, the arm-capturing bracket is adjustable for different sized arms.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 is a diagrammatic front elevational view of the present invention in use;

FIG. 2 is an exploded diagrammatic perspective view of the area generally enclosed by the dotted curve identified by arrow 2 in FIG. 1 of a first embodiment of the present invention;

FIG. 3 is a diagrammatic end elevational view taken generally in the direction of arrow 3 in FIG. 2;

FIG. 4 is a diagrammatic perspective view of the area generally enclosed by the dotted curve identified by arrow 4 in FIG. 1 of a second embodiment of the present invention; and FIG. 5 is a diagrammatic end elevational view taken generally in the direction of arrow 5 in FIG. 4.

First Embodiment

10 weight device of present invention for maintaining arm 12 in proper position for maximizing pectoral muscle 14 exercising

12 arm

14 pectoral muscle

16 arm-capturing bracket

18 hand-engaging handle

20 weight-engaging shaft

22 pair of ends of weight-engaging shaft 20

24 upper arm-capturing bracket of arm-capturing bracket 16

26 lower arm-capturing bracket of arm-capturing bracket 16

28 U-shaped plate of upper arm-capturing bracket 24 of arm-capturing bracket 16

30 top plate of U-shaped plate 28 of upper arm-capturing bracket 24 of arm-capturing bracket 16

32 pair of longitudinal edges of top plate 30 of U-shaped plate 28 of upper arm-capturing bracket 24 of arm-capturing bracket 16

34 pair of side plates of U-shaped plate 28 of upper arm-capturing bracket 24 of arm-capturing bracket 16

36 shoulder-facing edges of pair of side plates 34 of U-shaped plate 28 of upper arm-capturing bracket 24 of arm-capturing bracket 16

38 U-shaped plate of lower arm-capturing bracket 26 of arm-capturing bracket 16

40 top plate of U-shaped plate 38 of lower arm-capturing bracket 26 of arm-capturing bracket 16

42 pair of longitudinal edges of top plate 40 of U-shaped plate 38 of lower arm-capturing bracket 26 of arm-capturing bracket 16

44 pair of side plates of U-shaped plate 38 of lower arm-capturing bracket 26 of arm-capturing bracket 16

46 hand-facing edges of pair of side plates 44 of U-shaped plate 38 of lower arm-capturing bracket 26 of arm-capturing bracket 16

48 elbow-engaging sleeve of arm-capturing bracket 16

50 pair of ends of elbow-engaging sleeve 48 of arm-capturing bracket 16

51 arm of hand-engaging handle 18

52 free end of arm 51 of hand-engaging handle 18 for providing clearance for hand during exercising

54 handle of hand-engaging handle 18 for gripping by hand during exercising

56 weight

58 one clip of weight-engaging shaft 20 for replaceably maintaining weight 56 on weight-engaging shaft 20 during exercising

Second Embodiment

110 weight device

116 arm-capturing bracket

124 upper arm-capturing bracket of arm-capturing bracket 116

126 lower arm-capturing bracket of arm-capturing bracket 116

130 top plate of upper arm-capturing bracket 124 of arm-capturing bracket 116

140 top plate of lower arm-capturing bracket 126 of arm-capturing bracket 116

148 elbow-engaging sleeve of arm-capturing bracket 116

160 pair of top plates of top plate 130 of upper arm-capturing bracket 124 of arm-capturing bracket 116 for adjusting arm-capturing bracket 116 to adjusted position for different sized arms

162 pair of top plates of top plate 140 of lower arm-capturing bracket 124 of arm-capturing bracket 116

164 pair of elbow-engaging sleeves of elbow-engaging sleeve 148 of arm-capturing bracket 116

166 longitudinal wall of each sleeve of pair of elbow-engaging sleeves 164 of elbow-engaging sleeve 148 of arm-capturing bracket 116

168 threaded bore in longitudinal wall 166 of each sleeve of pair of elbow-engaging sleeves 164 of elbow-engaging sleeve 148 of arm-capturing bracket 116

170 screw of each sleeve of pair of elbow-engaging sleeves 164 of elbow-engaging sleeve 148 of arm-capturing bracket 116

DETAILED DESCRIPTION OF THE PREFERRED EMBODIMENT

Referring now to the figures, in which like numerals indicate like parts, and particularly to FIG. 1, the weight device of the present invention is shown generally at 10 for maintaining the arm 12 in a proper position for maximizing pectoral muscle 14 exercising.

The configuration of a first embodiment of the weight device 10 can best be seen in FIGS. 2 and 3, and as such, will be discussed with reference thereto.

The weight device 10 comprises an arm-capturing bracket 16, a hand-engaging handle 18 that extends from the arm-capturing bracket 16, and a weight-engaging shaft 20 that extends from the arm-capturing bracket 16 and has a pair of ends 22.

The arm-capturing bracket 16 comprises an upper arm-capturing bracket 24, and a lower arm-capturing bracket 26 that is fixedly attached to the upper arm-capturing bracket 24 of the arm-capturing bracket 16.

The upper arm-capturing bracket 24 of the arm-capturing bracket 16 comprises a U-shaped plate 28 that has a top plate 30 that is horizontally-oriented and has a pair of longitudinal edges 32, and a pair of side plates 34 that are vertically-oriented, depend form the pair of longitudinal edges 32 of the top plate 30 of the upper arm-capturing bracket 24 of the arm-capturing bracket 16, respectively, and have shoulder-facing edges 36.

The shoulder-facing edges 36 of the pair of side plates 34 of the upper arm-capturing bracket 24 of the arm-capturing bracket 16 are tapered for preventing interference with the shoulder muscles during exercising.

The lower arm-capturing bracket 26 of the arm-capturing bracket 16 comprises a U-shaped plate 38 that has a top plate 40 that is vertically-oriented, has a pair of longitudinal edges 42, and extends perpendicularly upwardly from the top plate 30 of the upper arm-capturing bracket 24 of the arm-capturing bracket 16, and a pair of side plates 44 that are vertically-oriented, extend horizontally outwardly from the pair of longitudinal edges 42 of the top plate 40 of the upper arm-capturing bracket 26 of the arm-capturing bracket 16, respectively, and have hand-facing edges 46.

The hand-facing edges 46 of the lower arm-capturing bracket 26 of the arm-capturing bracket 16 are tapered for preventing interference with the forearm muscles during exercising.

The upper arm-capturing bracket 24 of the arm-capturing bracket 16 meets the lower arm-capturing bracket 26 of the arm-capturing bracket 16 at an elbow-engaging sleeve 48 that is horizontally-oriented and has a pair of ends 50.

The elbow-engaging sleeve 48 of the arm-capturing bracket 16 connects the top plate 30 of the upper arm-capturing bracket 24 of the arm-capturing bracket 16 perpendicularly to the top plate 40 of the lower arm-capturing bracket 26 of the arm-capturing bracket 16.

The hand-engaging handle 18 comprises an arm 51 that is slender, elongated, and extends vertically upwardly from the top plate 40 of the lower arm-engaging bracket 26 of the arm-engaging bracket 16 to a free end 52.

The free end 52 of the arm 51 of the hand-engaging handle 18 is offset from, and parallel to the arm 51 of the hand-engaging handle 18, towards the upper arm-engaging bracket 24 of the arm-engaging bracket 16 for providing clearance for the hand during exercising.

The hand-engaging handle 18 further comprises a handle 54 that extends perpendicularly outwardly from the free end 52 of the arm 51 of the hand-engaging handle 18, away from the upper arm-engaging bracket 24 of the arm-engaging bracket 16 for gripping by the hand during exercising.

The weight-engaging shaft 20 extends through and past the pair of ends 50 of the elbow-engaging sleeve 48 of the arm-capturing bracket 16 for receiving a weight 56.

The weight-engaging shaft 20 comprises one clip 58 that is replaceably disposed on at least one end 22 of the weight-engaging shaft 20, outboard of an associated end 50 of the elbow-engaging sleeve 48 of the arm-capturing bracket 16, for replaceably maintaining the weight 56 on the weight-engaging shaft 20 during exercising.

The configuration of a second embodiment of the weight device 110 can best be seen in FIGS. 4 and 5, and as such, will be discussed with reference thereto.

The weight device 110 is identical to the weight device 10, except:

1) The top plate 130 of the upper arm-capturing bracket 124 of the arm-capturing bracket 116 is a pair of top plates 160 that are separate from, and overlie, each other and slide relative to each other for adjusting the arm-capturing bracket 116 to an adjusted position for different sized arms.

2) The top plate 140 of the lower arm-capturing bracket 126 of the arm-capturing bracket 116 is a pair of top plates 162 that are separate from, and overlie, each other and slide relative to each other, with each plate of the pair of top plates 162 of the lower arm-capturing bracket 126 of the arm-capturing bracket 116 being affixed to, and moving with, an associated top plate of the pair of top plates 160 of the upper arm-capturing bracket 124 of the arm-capturing bracket 116.

3) The elbow-engaging sleeve 148 of the arm-capturing bracket 116 is a pair of elbow-engaging sleeves 164 that are separate and spaced from each other, with each sleeve of the pair of elbow-engaging sleeves 164 of the arm-capturing bracket 116 moving with an associated top plate 162 of the lower arm-capturing bracket 126 of the arm-capturing bracket 116 and an associated top plate 160 of the upper arm-capturing bracket 124 of the arm-capturing bracket 116.

4) Each sleeve of the pair of elbow-engaging sleeves 164 of the arm-capturing bracket 116 has a longitudinal wall 166 with a threaded bore 168 extending therethrough.

5) Each sleeve of the pair of elbow-engaging sleeves 164 of the arm-capturing bracket 116 further has a screw 170 that threadably engages in the threaded bore 168 in the longitudinal wall 166 thereof, and when tightened, snugs up against the weight-engaging shaft 120 and maintains the arm-capturing bracket 116 in the adjusted position thereof.

It will be understood that each of the elements described above, or two or more together, may also find a useful application in other types of constructions differing from the types described above.

While the invention has been illustrated and described as embodied in a weight device for maintaining the arm in a proper position for maximizing pectoral muscle exercising, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A weight device for maintaining the arm in a proper position for maximizing pectoral muscle exercising, comprising:

A) an arm-capturing bracket;

B) a hand-engaging handle extending from said arm-capturing bracket; and

C) a weight-engaging shaft extending from said arm-capturing bracket and having a pair of ends, wherein said arm-capturing bracket comprises:

i) an upper arm-capturing bracket; and ii) a lower arm-capturing bracket that is fixedly attached to said upper arm-capturing bracket of said arm-capturing bracket, wherein said upper arm-capturing bracket of said arm-capturing bracket comprises a U-shaped plate that has:

a) a top plate that is horizontally-oriented and has a pair of longitudinal edges; and b) a pair of side plates that are vertically-oriented, depend from said pair of longitudinal edges of said top plate of said upper arm-capturing bracket of said arm-capturing bracket, respectively, and have shoulder-facing edges.

2. The device as defined in claim 1, wherein said shoulder-facing edges of said pair of side plates of said upper arm-capturing bracket of said arm-capturing bracket are tapered for preventing interference with the shoulder muscles during exercising.

3. The device as defined in claim 1, wherein said lower arm-capturing bracket of said arm-capturing bracket comprises a U-shaped plate that has:

a) a top plate that is vertically-oriented, has a pair of longitudinal edges, and extends perpendicularly upwardly from said top plate of said upper arm-capturing bracket of said arm-capturing bracket; and b) a pair of side plates that are vertically-oriented, extend horizontally outwardly from said pair of longitudinal edges of said top plate of said upper arm-capturing bracket of said arm-capturing bracket, respectively, and have hand-facing edges.

4. The device as defined in claim 3, wherein said hand-facing edges of said lower arm-capturing bracket of said arm-capturing bracket are tapered for preventing interference with the forearm muscles during exercising.

5. The device as defined in claim 3, wherein said upper arm-capturing bracket of said arm-capturing bracket meets said lower arm-capturing bracket of said arm-capturing bracket at an elbow-engaging sleeve that is horizontally-oriented and has a pair of ends.

6. The device as defined in claim 5, wherein said elbow-engaging sleeve of said arm-capturing bracket connects said top plate of said upper arm-capturing bracket of said arm-capturing bracket perpendicularly to said top plate of said lower arm-capturing bracket of said arm-capturing bracket.

7. The device as defined in claim 3, wherein said hand-engaging handle comprises an arm that is slender, elongated, and extends vertically upwardly from said top plate of said lower arm-engaging bracket of said arm-engaging bracket to a free end.

8. The device as defined in claim 7, wherein said free end of said arm of said hand-engaging handle is offset from, and parallel to said arm of said hand-engaging handle, towards said upper arm-engaging bracket of said arm-engaging bracket for providing clearance for the hand during exercising.

9. The device as defined in claim 6, wherein said hand-engaging handle further comprises a handle that extends perpendicularly outwardly from said free end of said arm of said hand-engaging handle, away from said upper arm-engaging bracket of said arm-engaging bracket for gripping by the hand during exercising.

10. The device as defined in claim 5, wherein said weight-engaging shaft extends through and past said pair of ends of said elbow-engaging sleeve of said arm-capturing bracket for receiving a weight.

11. The device as defined in claim 5, wherein said weight-engaging shaft comprises one clip that is replaceably disposed on at least one end of said weight-engaging shaft, outboard of an associated end of said elbow-engaging sleeve of said arm-capturing bracket, for replaceably maintaining the weight on said weight-engaging shaft during exercising.

12. The device as defined in claim 5, wherein said top plate of said upper arm-capturing bracket of said arm-capturing bracket is a pair of top plates that are separate from, and overlie, each other and slide relative to each other for adjusting said arm-capturing bracket to an adjusted position for different sized arms.

13. The device as defined in claim 12, wherein said top plate of said lower arm-capturing bracket of said arm-capturing bracket is a pair of top plates that are separate from, and overlie, each other and slide relative to each other, with each plate of said pair of top plates of said lower arm-capturing bracket of said arm-capturing bracket being affixed to, and moving with, an associated top plate of said pair of top plates of said upper arm-capturing bracket of said arm-capturing bracket.

14. The device as defined in claim 13, wherein said elbow-engaging sleeve of said arm-capturing bracket is a pair of elbow-engaging sleeves that are separate and spaced from each other, with each sleeve of said pair of elbow-engaging sleeves of said arm-capturing bracket moving with an associated top plate of said lower arm-capturing bracket of said arm-capturing bracket and an associated top plate of said upper arm-capturing bracket of said arm-capturing bracket.

15. The device as defined in claim 14, wherein each sleeve of said pair of elbow-engaging sleeves of said arm-capturing bracket has a longitudinal wall with a threaded bore extending therethrough.

16. The device as defined in claim 15, wherein each sleeve of said pair of elbow-engaging sleeves of said arm-capturing bracket further has a screw that threadably engages in said threaded bore in said longitudinal wall thereof, and when tightened, snugs up against said weight-engaging shaft and maintains said arm-capturing bracket in said adjusted position thereof.

* * * * *